United States Patent [19]

Akado et al.

[11] 4,087,966

[45] May 9, 1978

[54] EXHAUST GAS CLEANING DEVICE

[75] Inventors: Hajime Akado, Kariya; Yutaka Kawashima, Okazaki; Akihide Yamaguchi; Hideki Matsuura, both of Kariya, all of Japan

[73] Assignee: Nippondenso Co., Ltd., Kariya, Japan

[21] Appl. No.: 639,590

[22] Filed: Dec. 10, 1975

Related U.S. Application Data

[62] Division of Ser. No. 465,625, Apr. 30, 1974, Pat. No. 3,937,015.

[30] Foreign Application Priority Data

| | | |
|---|---|---|
| May 3, 1973 | Japan | 48-50130 |
| Jun. 1, 1973 | Japan | 48-62402 |
| Jun. 8, 1973 | Japan | 48-65231 |

[51] Int. Cl.[2] ..... F02M 25/06

[52] U.S. Cl. ..... 60/278; 60/302

[58] Field of Search ..... 60/278, 279, 302, 299, 60/311, 282; 55/498, DIG. 30

[56] References Cited

U.S. PATENT DOCUMENTS

| | | | |
|---|---|---|---|
| 2,673,446 | 3/1954 | Salardi | 60/279 |
| 3,066,755 | 12/1962 | Diehl | 60/278 |
| 3,166,895 | 1/1965 | Slayter | 60/302 |
| 3,247,666 | 4/1966 | Behrens | 60/302 |
| 3,633,343 | 1/1972 | Mark | 60/311 |
| 3,826,067 | 7/1974 | Wilder | 60/311 |
| 3,857,688 | 12/1974 | Wisnewski | 60/311 |
| 3,972,184 | 8/1976 | Warren | 60/302 |

FOREIGN PATENT DOCUMENTS

| | | | |
|---|---|---|---|
| 1,443,886 | 5/1966 | France | 23/288 F |

*Primary Examiner*—Douglas Hart

*Attorney, Agent, or Firm*—Cushman, Darby & Cushman

[57] ABSTRACT

This specification discloses an exhaust gas cleaning device which is intended for removing harmful substances from exhaust gases of internal combustion engine, especially for removing carbon particles or the like.

The device has a body accomodating a filter element adapted to catch the particles in the exhaust gases. The device is attached to the engine as if it were an exhaust manifold so that the clogging particles are conveniently burned by hot gases, whereby the filter element is conveniently recovered.

9 Claims, 28 Drawing Figures

EXHAUST GAS CLEANING DEVICE

This application is a division of our copending application Ser. No. 465,625, filed Apr. 30, 1974, which is now U.S. Pat. No. 3,937,015.

The present invention relates to an exhaust gas cleaning device for internal combustion engines and more particularly to a device for reducing the amount of carbon particles or the like, as well as other harmful substances, in the exhaust emissions.

Exhaust gases from internal combustion engines contain considerable amounts of particles of carbon or the like, as well as other harmful substances such as nitrogen monoxide (NOx), carbon oxide (CO) and hydrocarbon (HC). Especially the exhaust gases from diesel engines are rich in those carbon particles or the like which is so called smoke.

Hitherto, two types of devices have been proposed for the purpose of catching the carbon particles or the like. Devices of these two types, i.e. dry type and wet type can, catch the particles, but the catching effect can be maintained only for a short period because of the clogging of the device by the caught particles. Therefore, as far as these two types of devices are concerned, it is necessary to restore the catching effect by suitably removing the particles from the devices.

For the purpose of removing the clogging particles, there has been proposed two methods. The first one is to remove the clogging particles mechanically, and the second includes what is called an after-burner system in which the clogging particles are burned by the heat generated in the after-burner. The mechanical way is inconvenient in that it is required to treat the removed particles in a suitable manner with resulting expensive treating equipment. The after-burner system is also inconvenient in that a certain amount of fuel is required for the after-burning, as well as expensive systems for igniting, fuel feeding and air supplying.

The present invention is directed to avoiding the above described shortcomings by providing an improved exhaust gas cleaning device.

According to the invention, there is provided an exhaust gas cleaning device comprising a body, a heat resistant filtering element disposed within said body, said element having filtering material corrugated in a circumferential direction so as to form a wall having a corrugated, round cross-section, said wall dividing the space within said body into first and second spaces, said first space communicating with at least one inlet port which is formed in said body, said second space communicating with an outlet port which is also formed in said body, said inlet port directly communicating with exhaust ports of the internal combustion engine when assembled.

Since the exhaust gases of high temperature are fed through the inlet port to the first space along with the carbon particles or the like, those particles are conveniently caught by the filtering element and burned due to the high temperature of the exhaust gases.

It is to be noted that the corrugation of the filtering material provides a large filtering surface for a predetermined volume of the filtering element.

In another aspect of the invention, the exhaust gases which have passed through the filtering element are returned to the suction side of the engine. Since the returned gases contain only a small amount of particles, the rapid wear of the cylinder liner or contamination of lubrication oil is less likely to occur.

In a still another aspect of the invention, the device comprises a by-pass passage which connects the first space directly to the outlet port. A valve is provided for opening and closing the by-pass passage.

By so constructing the filter, it becomes possible to make the exhaust gases flow through the filtering material and through the by-pass passage, selectively, whereby the filtering material becomes available for a longer period.

The above and other objects and features of the invention will become apparent from the description of embodiments which will be made hereinafter making reference to attached drawings in which.

DETAILED DESCRIPTION

Figure 1:
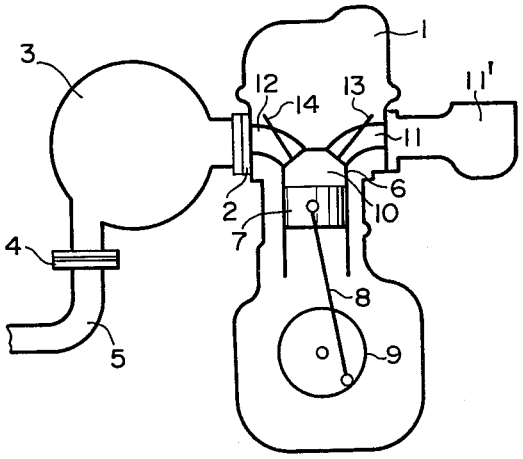
FIG. 1 shows diagrammatically an internal combustion engine being equipped with an exhaust cleaning device according to the invention.

Referring to FIG. 1, the numeral 1 designates an internal combustion engine, 2 and 4 are gaskets, 3 points to an exhaust gas cleaning device of the present invention and 5 designates an exhaust pipe.

The engine 1 comprises a piston 7 which is adapted for reciprocating within a cylinder 6. The reciprocating motion of the piston 7 is converted into a rotational movement through a connecting rod 8 and a crank mechanism 9.

A suction port 11 and an exhaust port 12 are formed in the cylinder 6 and are provided with a suction valve 13 and an exhaust valve 14, respectively.

The gases generated through the combustion in the combustion chamber 10 are exhausted through the exhaust port 12 during the opening phase of the exhaust valve 14.

The engine under discussion is supposed to have four cylinders, and accordingly four ports and four valves.

Figure 2:
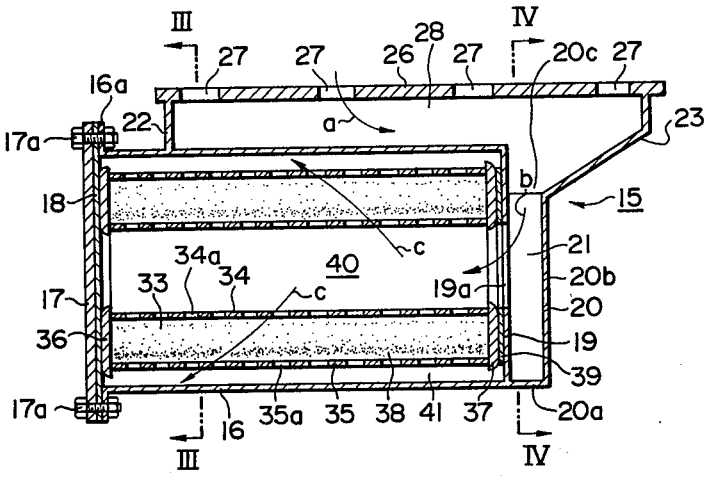
FIG. 2 shows an embodiment of the invention in section along the longitudinal axis.
Figure 3:
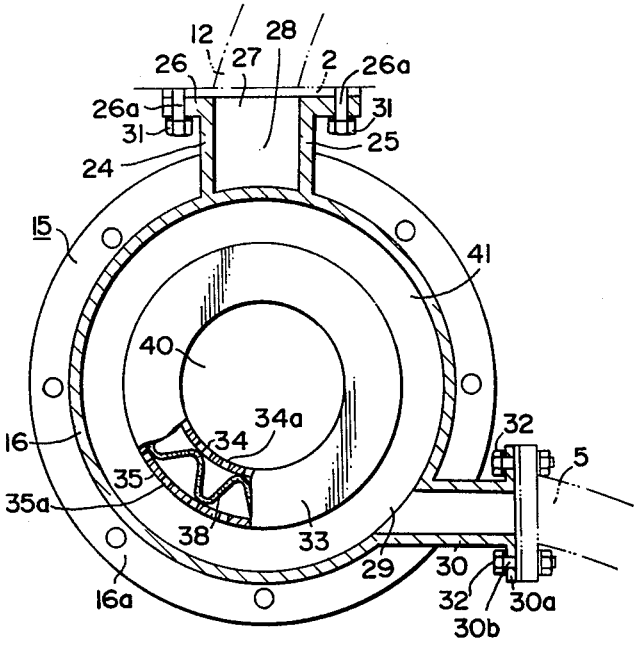
FIG. 3 is a cross-sectional view along the III—III line of FIG. 2.
Figure 4:
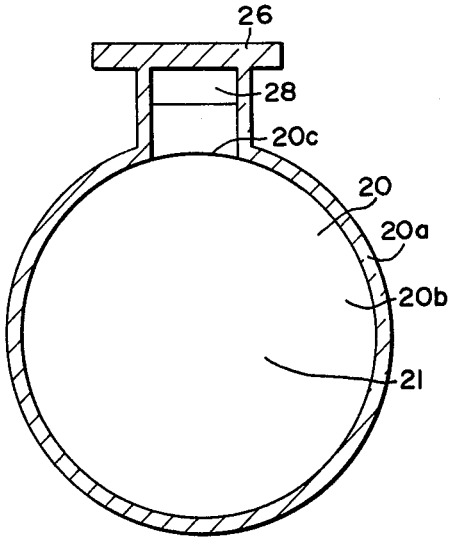
FIG. 4 is cross-sectional view along the IV—IV line of FIG. 2.

The exhaust cleaning device 3 is attached to the engine 1, merely through the medium of the gasket 2 in such a manner that each inlet port of the device 3 (these ports will be described later) directly communicates with the corresponding exhaust port of the engine, respectively. In other words, the exhaust gas cleaning device 3 is attached to the engine as if the device 3 were an exhaust manifold. The device 3 is connected to the exhaust pipe 5 through the medium of the gasket 4 so that the outlet port (this will be described later) of the device communicates with the exhaust pipe 5. The device 3 is fully illustrated in FIGS. 2 through 4.

In the Figures, the body of the device 3 is generally designated at 15.

The body 15 includes a cylindrical casing 16 one of the open ends of which has a flange 16*a*.

A cap 17 is fixed to the flange 16*a* through a ring-like gasket 18 by bolts 17*a* to close said open end of the casing 16.

Numeral 19 designates a disc-like guide plate having a large central port 19*a*.

An end plate 20 consists of a cylindrical portion 20*a* and a bottom plate portion 20*b*, and is fixed to the other open end of the casing 16 by means of, for example, welding.

The cylindrical portion 20*a* of the end plate 20 is cut away over a certain length to provide a passage 20*c* for the exhaust gases.

The end plate 20 also defines a passage space 21, cooperating with the guide plate 19.

A left-hand side wall 22 is secured to the outer surface of the casing 16 over a certain circumferential length of the casing 16, while a right-hand side wall 23 is welded to the bottom plate 20*b* at portion where the passage 20*c* is provided.

Numerals 24 and 25 (See FIG. 3) designate upper and lower walls, respectively, which are secured to the outer surface of the casing 16, to the outer surface of the cylindrical portion 20*a* of the end plate 20, as well as to the left-hand and right-hand side walls 22, 23, by means of for instance welding.

A flange 26 is secured to the walls 22, 23, 24 and 25 by, for example, welding and is maintained a suitable distance between itself and the casing 16. This flange has four inlet ports 27 which are disposed in parallel with the axis of the casing 16 and are spaced so that they may correspond to the exhaust ports 12 of the engine 1 to which the body 15 is to be attached.

The body 15 can be attached to engine 1 by means of bolts 31 which penetrate the assembly apertures 26*a*, with the gasket 2 interposed therebetween, whereby each inlet port 27 communicates directly with the corresponding exhaust port 12 of the engine 1.

An inlet space 28 is defined by casing 16, left-hand and right-hand side walls 22, 23, and upper and lower wall 24, 25, which communicate at one end to the inlet ports 27 and at the other end to the passage space 21 via passage 20*c*.

An outlet port 29 is provided in the casing 16, for the communication with an outlet pipe 30 which is connected to the exhaust pipe 5.

The connection of the outlet pipe 30 to the exhaust pipe 5 is made through flange 30*a* in which a plurality of assembly apertures 30*b* are provided.

The body 15 including the above described elements can be produced unitarily by molding or casing.

Preferably, the body 15 is enveloped by a heat insulating material as will be described later.

A cylindrically formed filtering element 33 comprises an inner cylindrical wall 34 and an outer cylindrical wall 35 which have a plurality of through holes 34*a* and 35*a*, respectively.

Left-hand and right-hand end plates 36 and 37 are secured to the axial ends of both cylindrical walls 34 and 35 so as to close the annular openings between these two cylindrical walls.

Filtering material 38 is disposed within the annular space which is defined by the cylindrical walls 34, 35 and end plates 36, 37.

The filtering element 33 thus constructed is disposed within the casing 16 in such a manner that the left-hand end plate 36 is fixed to the cap 17 through the gasket 18 and that the right-hand end plate 37 is fixed to the guide plate 19 through a ring-like gasket 39. Accordingly, the space within the casing 16 is divided into two chambers, one of which is inner chamber 40 defind within the inner cylindrical surface of the filtering element 33, while the other is an outer chamber 41 defined between the outer cylindrical surface and the inner surface of the casing 16.

The central port 19*a* of the guide plate 19 has a diameter almost equal to the inner diameter of the filtering element 33.

The inner chamber 40 communicates with the passage space 21 through the central port 19*a*, while the outer chamber 40 communicates with the outlet pipe 30 through the outlet port 29.

The filtering material 38 may be fabricated from gauze wire of stainless steel or a porous body of ceramic material, or similar heat resistant material.

When the gauze wire of stainless steel is employed as the filtering element 38, it is preferable to corrugate the gauze wire in the circumferential direction along the cylindrical walls 34, 35 in such a manner that each valley and each top ridge of the corrugation are fixed to the cylindrical walls 34, 35. With respect to this corrugation, the detail will be described later in connection with another embodiment of the invention.

When the ceramic material is to be used, it is possible to eliminate the cylindrical walls 34, 35 by forming the ceramic in a cylindrical shape of a self supporting nature.

The installation of the filtering element 33 into the casing 16 can be conveniently, effected by removing the cap 17.

Since the inner chamber 40 communicates with the passage space 21 and inlet space 28, the chamber 40 and the spaces 21, 28 can be considered as constituting a single space. Therefore, the space within the body 15 is divided into two spaces or chambers.

Thus, the chamber including the inner chamber 40, passage space 21 and inlet space 28 will be hereinafter referred as "first space," while the outer chamber 41 will be called "second space."

In operation, the exhaust gases are directly fed into the inlet space 28 through the inlet port 27 as shown by an arrow *a* when the corresponding cylinder 6 of the engine 1 is at exhausting stroke. Assuming that the load applied to the engine is heavy, the temperature of the exhaust gases is high enough to burn the carbon particles, so that a part of the carbon particles or the like contained in the gases are burned away as it passes the inlet space 28. It will be understood that the inlet space 28 provides a field of high temperature which is suitable for the burning.

The inventors have confirmed through a series of experiments that the burning of the carbon particles is commenced at a temperature as low as about 500° C, and that 10 to 15 percent of the particles are burned away at the inlet space 28 when the engine is operated at full load.

When the load applied to the engine is low, the exhaust temperature is relatively low, so that almost all of the carbon particles is passed through the inlet 20*c* and the passage space 21 into the inner chamber 40 as shown by an arrow *b* without being burned.

The gases which reach the inner chamber 40 then flow through the filtering element 33 as shown by an arrow *c*, during which the carbon particles or the like contained in the gases are conveniently caught by the filtering material 38 which is made of stainless steel gauze wire or a porous body of ceramic as aforementioned, whereby the gases which are free from those carbon particles or the like are passed through to the outer chamber 41 and emitted into the atmosphere through outlet port 29, outlet pipe 30 and then the exhaust pipe 5.

During heavy load phase of the engine, the exhaust temperature is so high that the inlet chamber is maintained at a high temperature, as a result of which the filtering element is heated up to a temperature high enough to burn the carbon particles or the like which have been caught by the filtering material 38.

Thus, the carbon particles or the like clogging the filtering element 33 are completely burned out, whereby the function of the filtering element 33 is restored.

It will be understood that, even if the engine were operated at low load for a while thereby clogging the element with the carbon particles, a subsequent full load operation of the engine would surely enable the filtering element to be renewed, i.e. recovered.

Since the construction is such that the exhaust gases flow through the inlet space 28 and then through the passage space 21 to the filtering element, and that the filtering element 33 of large heat capacity disposed in the inner chamber 40 can be maintained at a higher temperature than the inlet space 28, the burning of the carbon particles is enhanced in the inner chamber 40 and is the filtering element 33 so that the recovery of the clogged filtering element 33 becomes very easy.

The inventors have confirmed through experiments that the temperature at the inner chamber 40 can be maintained at a temperature which is higher than the temperature at the inlet space by 40° to 120° C. This means that the heat energy existing in the exhaust gases is effectively utilized.

Figure 5:
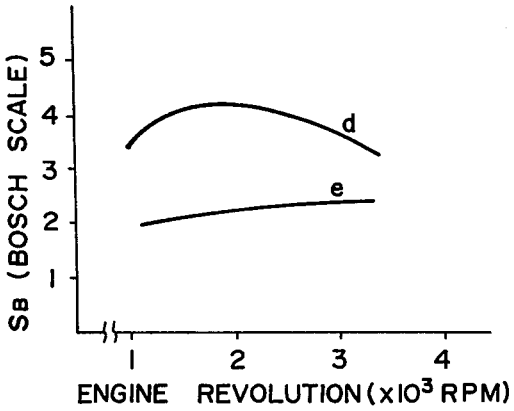
FIG. 5 is a graph which shows relationships between engine revolutions and smoke densities.

As aforementioned, the carbon particles or the like, which is so called smoke is thick especially in diesel engines. FIG. 5 shows the result of the test conducted on a diesel engine to seek the relationship between the smoke thickness and the engine revolutions at full load operation. In the diagram, the abscissa is plotted in accordance with engine revolutions in R.P.M., while the ordinate is plotted according to the smoke thickness in the Bosch scale.

The curve "*d*" represents the smoke thickness of the engine which comprises a conventional exhaust system, while the curve "*e*" represents the smoke thickness of the engine having the exhaust gas cleaning device of the present invention.

It will be understood that the exhaust gas cleaning device of the invention is highly effective in reducing the smoke thickness at each engine speed. It has been confirmed through the experiments also that the exhaust cleaning device of the invention does not affect the engine performance.

Figure 6:
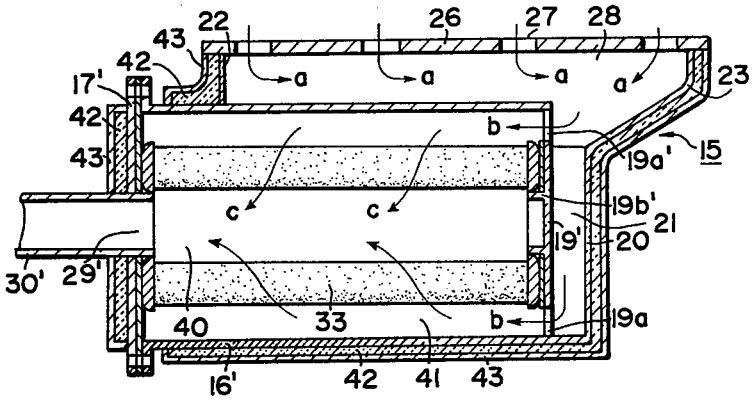
FIG. 6 shows a further embodiment of the invention in section along the longitudinal axis thereof.

FIG. 6 shows the second embodiment of the invention. In this second embodiment, a plurality of through holes 19*a*′ is provided at the peripheral edge of the guide plate 19′, through which the outer chamber 41 within the casing 16′ communicates with the passage space 21 and the inlet space 28.

The cap 17′ comprises an outlet port 29′ which is connected to the outlet pipe 30′.

A cylindrical projection 19*b*′ formed in the guide plate 19′ and the portion of the outlet pipe which projects inwardly of the case 16 cooperates to correctly centralize the filtering element 33.

The outer surface of the body 15 is covered with an heat insulating layer 42 so as to prevent the heat from escaping to the ambient air.

Preferably, a cover 43 is provided over the body 15 with a certain gap left therebetween for accomodating the insulating material 42.

It will be apparent that the device of the first embodiment may comprise this heat insulating construction.

In this second embodiment, the first space consists of the inlet space 28, passage space 21 and the outer chamber 41, whereas the second space is constituted by the inner chamber 40, so that the gases pass the filtering element 33 from outside to inside.

Although the direction of the gas flow is contrary to the case of the first embodiment, the carbon particles can be removed from the exhaust gases as well.

Figure 7:
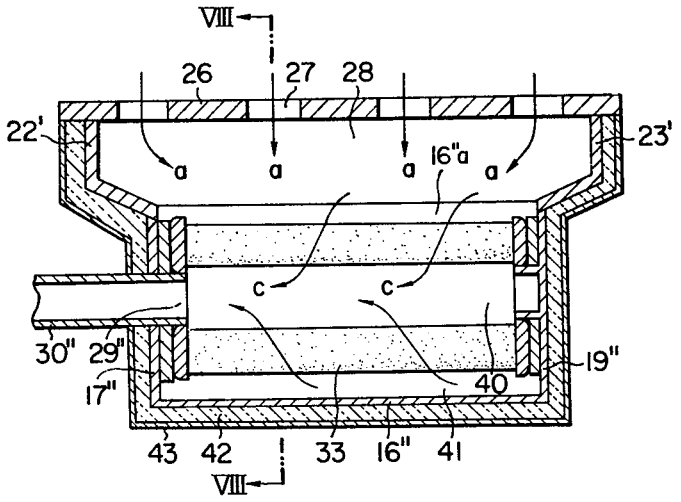
FIG. 7 shows still a further embodiment of the invention in section along the longitudinal axis thereof
Figure 8:
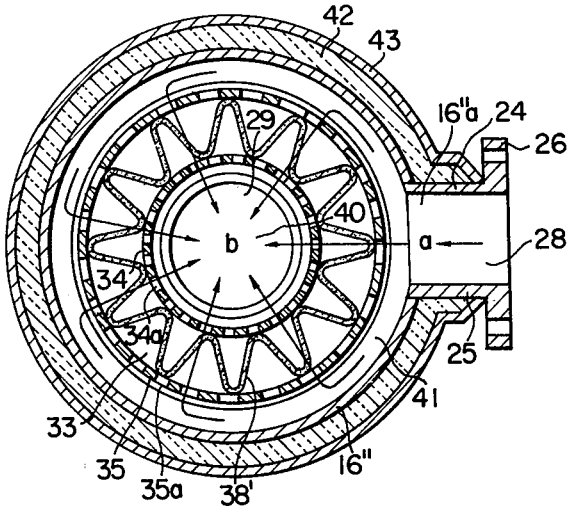
FIG. 8 shows a cross-section taken along the VIII—VIII line of FIG. 7.

FIGS. 7 and 8 show the third embodiment of the invention.

In this embodiment, the inlet space 28 directly communicates with the outer chamber 41. Thus, the casing 16″ is cut away over a certain circumferential length so as to provide a passage 16a'' for the gases. The open ends of the casing 16'' are closed by left-hand side plate 17'' and right-hand side plate 19'', respectively. Left-hand wall 22 and right-hand wall 23, as well as upper and lower walls 24, 25 are provided so as to define the passage 16a''. The filtering element 33 is disposed within the casing 16'' concentrically therewith so as to define the inner chamber 40 and the outer chamber 41. Thus, the inlet space 28 and the outer chamber 41 constitute the first space, whereas the inner chamber 40 constitutes the second space.

The outlet port 29'' is formed in the left-hand side plate 17'' which receives the end portion of the outlet pipe 30.

The casing 16'' is preferably assembled from some sections so as to make it possible to install the filtering element 33 within the casing 16''.

The casing 16'', the left-hand and right-hand walls 22, 23 and the upper and lower walls 24, 25 are coated with heat insulating material 42.

In operation, the gases exhausted from the exhaust ports 12 are fed through the inlet ports 27, the inlet space 28 and the passage 16a'' as shown by an arrow "*a*," to the outer chamber 41. The gases then pass through the filtering element 33 toward the inner chamber 40, as illustrated by an arrow "*c*," during which the carbon particles or the like are removed in almost the same manner as in the case of the first embodiment.

FIG. 8 shows the filtering element 33 having filtering material 38'' which is made of stainless steel gauze wire. Cylindrical inner and outer walls 34, 35 are disposed concentrically with each other with a certain radial distance left therebetween for accomodating the corrugated filtering material 38''. The valleys and crests of the corrugation are fixed to the inner or outer cylindrical wall 34, 35. The two cylindrical walls comprise a plurality of through holes for passing the gases, respectively.

It will be understood that the working surface of the filtering element is greatly increased for a given volume of the element because of the corrugation of filtering material 38', so that the cleaning effect can be greatly enhanced.

However, as far as the construction of FIGS. 7 and 8 are concerned, the filtering element 33 tends to be contaminated especially at the portion facing the inlet space 28 because almost all of the exhaust gases are likely to pass through this portion. Therefore, the filtering element is likely to be damaged at this portion, resulting in shorter service life.

Figure 9:
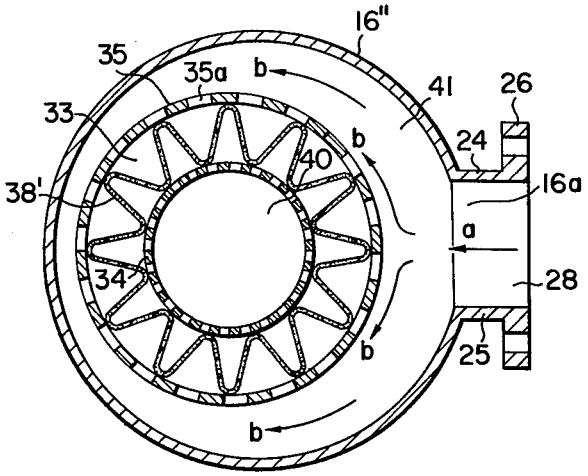
FIG. 9 is a radial cross-sectional view of still another embodiment of the invention.

This problem can however be solved in the following manner. Namely, in the fourth embodiment as illustrated in FIG. 9, the filtering element 33 is disposed in such a manner that the center thereof is offset from the center of the casing 16'' in the direction away from the inlet space 28. In this construction, the exhaust gases do not concentrate in a limited zone on the filtering element but can spread widely so that the local contamination of the filtering element is avoided.

Figure 10:
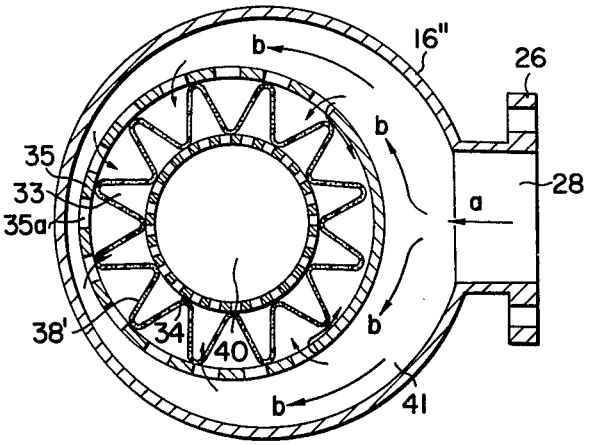
FIG. 10 is a radial cross-sectional view of still another embodiment of the invention.

In the fifth embodiment as illustrated in FIG. 10, the filtering element is disposed excentrically in the same manner as in the case of FIG. 9, and in addition, no through hole is provided in the outer cylindrical wall 35 at the portion facing the inlet space 28. Accordingly, the exhaust gases fed through the inlet space 28 are baffled by the outer cylindrical wall 35 to flow along the wall 35 as shown by an arrow *b* and then enter into the filtering element 35 in a more even manner, whereby the unfavorable local contamination of the filtering element 33 is avoided.

Preferably, the crests of the corrugated filtering material at the portion nearest to the inlet space 28 are kept separated from the inner surface of the outer cylindrical wall 35 so that the gas may pass through the gap between the crests and the cylindrical wall 35.

Figure 11:
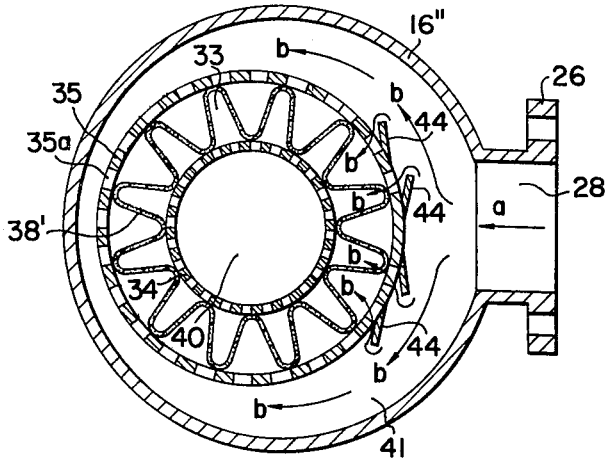
FIG. 11 is a radial cross-sectional view of still another embodiment of the invention.

In the sixth embodiment as shown in FIG. 11, the filtering element is disposed excentrically as is the case of FIG. 9, and in addition baffle plates 44 are fixed to the outer cylindrical wall 44 at the portion facing the inlet space 28. These baffle plates may be flat or arcuate. These baffle plates are oriented in a tangential direction of the outer cylindrical wall 35 or bent outwardly, so as to cover the through holes 35a behind the baffling plate.

Figure 12:
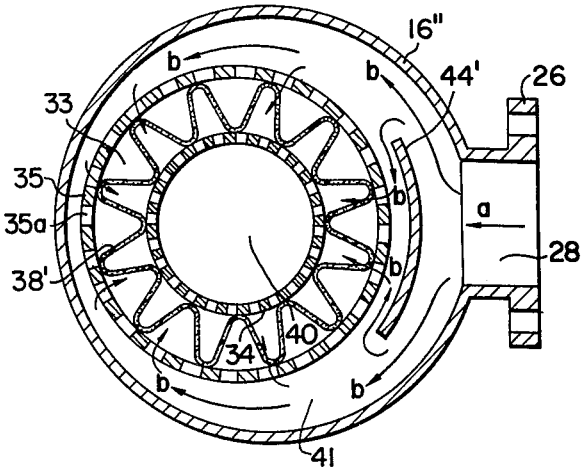
FIG. 12 is a radial cross-sectional view of still another embodiment of the invention.

In the seventh embodiment as shown by FIG. 12, a baffling plate 44' is disposed between the inlet space 28 and the cylindrical wall 35.

It will be understood that the baffling plates 44, 44' enable the exhaust gas to enter the filtering element evenly therearound whereby the local contamination of the filtering material 38' is substantially avoided.

Figure 13:
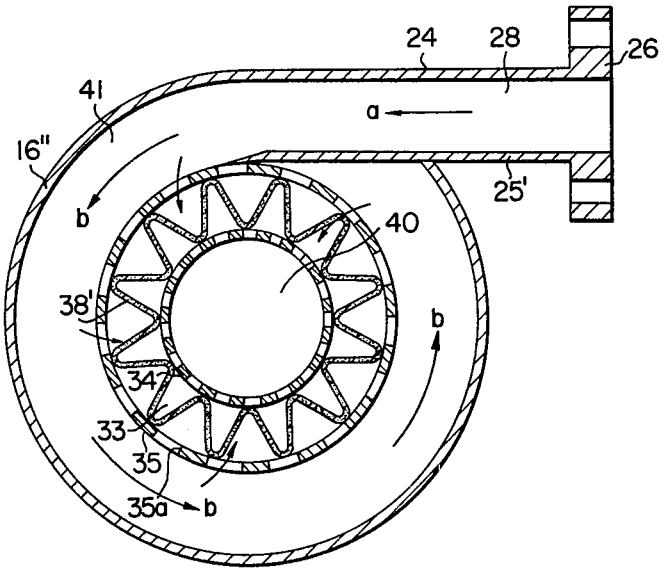
FIG. 13 is a radial cross-sectional view of still another embodiment of the invention.

The eighth embodiment is shown in FIG. 13.

In this embodiment, the filtering element 33 is disposed within the casing 16'' concentrically therewith. This embodiment is characterized in that the inlet space 28 is connected to the outer chamber 41 in a tangential direction of the latter. To this end, the left-hand and the right-hand side walls (not shown) and the upper and lower walls 24, 25' are secured to the casing 16'' in such a manner that the inlet space 28 defined by those walls is orientated tangentially with respect to the casing 16''.

In the construction as illustrated in FIG. 13, the lower wall 25 projects inwardly of the casing 16'' to reach the outer cylindrical wall 35.

Therefore, the exhaust gases flow circumferentially along the inner surface of the casing 16'' and gradually enters the filtering element 33, whereby the distribution of the gases over the filtering element becomes even and the local contamination is avoided.

Now a description will be made with respect to the embodiments of the second type in which the exhaust gases which have been cleaned by the device of the invention are returned to the suction side of the engine. Such a system for recirculating the exhaust gases is known as an E.G.R. system, which is effective in cleaning the exhaust emissions from the internal combustion engines.

In the E.G.R. system, the recirculation of the exhaust gases is controlled upon detecting the mode of engine operation, especially the load applied to the engine. It has been pointed out that the suction side of the engine is likely to be contaminated by the carbon particles or the like which are contained in the returned exhaust gases, whereby the engine performance is considerably affected and the wear of the cylinder is greatly increased. In this connection, the present invention provides a particular effect to avoid such shortcomings in the E.G.R. systems, by removing the carbon particles or the like from the exhaust gases to be returned to the suction side of the engine.

Figure 14:
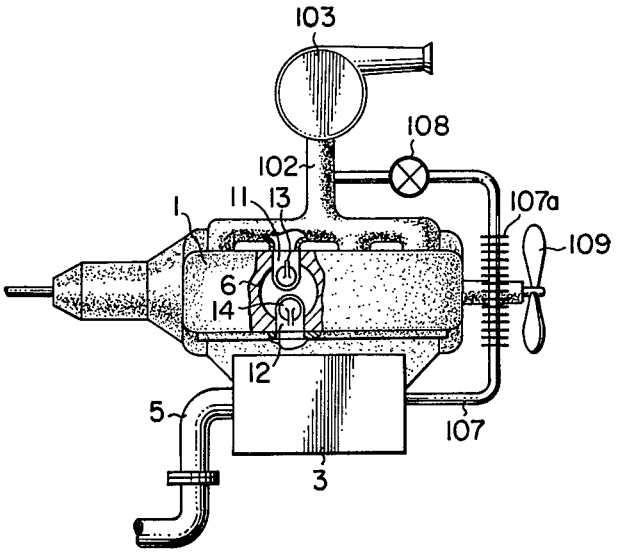
FIG. 14 shows a general arrangement of the exhaust system of an internal combustion engine being equipped with an embodiment of the invention of the second type in which a part of the cleaned exhaust gases is returned to the suction side of the engine.

FIG. 14 shows a general arrangement of the E.G.R. system, in which the exhaust cleaning device of the invention is incorporated.

The system of FIG. 14 is almost the same as the system in FIG. 1, except that a by-pass pipe 107 is provided for connection between the exhaust gas cleaning device 103 and the suction manifold 102 of the engine. A valve 108 is provided at a position intermediate of the pipe 107, and is adapted to be controlled in accordance with the variation of the engine speed and the load applied to the engine. A fan 109 is provided for cooling the exhaust gases in the by-pass pipe 107. To this end, radiation fins 107*a* are provided at the surface of the by-pass pipe 107 at the portion facing the fan 109.

Supposing that the engine 1 is a diesel engine, the fresh air is fed through the air cleaner 103 and then through the suction manifold 102, to the cylinder 6, whereas the fuel is directly injected into the cylinder 6 for combustion.

Supposing that the engine 1 is a gasoline engine, the fuel and air mixture are generated in a carburetor (not shown).

The gases generated during the combustion in the cylinder 6 are fed into the exhaust cleaning device 3, where the gases are cleaned and emitted from the exhaust pipe 5. However, when the valve 108 is opened, a portion of the cleaned exhaust gases is returned to the suction manifold 102 of the engine through the by-pass pipe 107.

The opening and closing motion of the valve 108, and the opening degree of the valve 108 are controlled in accordance with the variations in the engine speed and the load applied to the engine.

Figure 15:
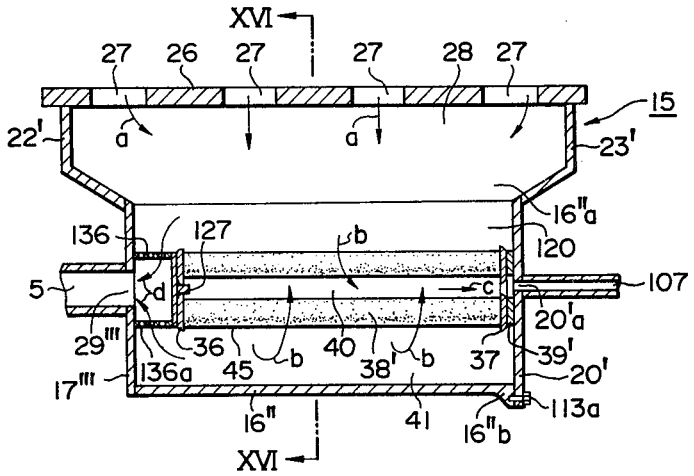
FIG. 15 shows an example of the embodiment of the second type in section along the longitudinal axis thereof.
Figure 16:
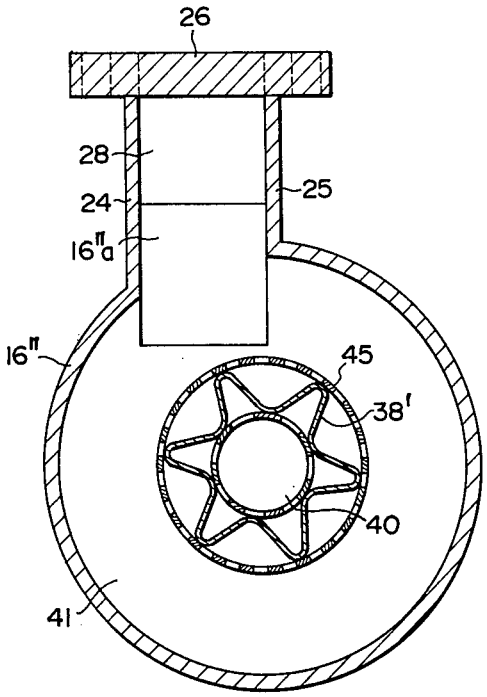
FIG. 16 shows the cross section taken along the XVI—XVI line of FIG. 15.

The first example of the device 3 as employed in the E.G.R. system is shown by FIG. 15.

The whole construction of the cleaning device body 15 is almost the same as those of the device as explained before, except that the inner chamber 40, which is defined within a filtering element 45 having an annular cross-section, communicates with the by-pass pipe 107 through the port 20*a*′ formed in an end plate 20′. Numeral 136 designates a support for the filtering element 45, having a cylindrical shape with at least one through hole 136*a*. The open end of the support 136 is fixed to a left-hand side plate 17‴ so as to surround the outlet port 29‴ formed in the plate 17‴. The support 136 comprises at its closed end a protrusion 127 which is adapted for locating and holding the left-hand end plate 36 of the filtering element 45.

Figure 17:
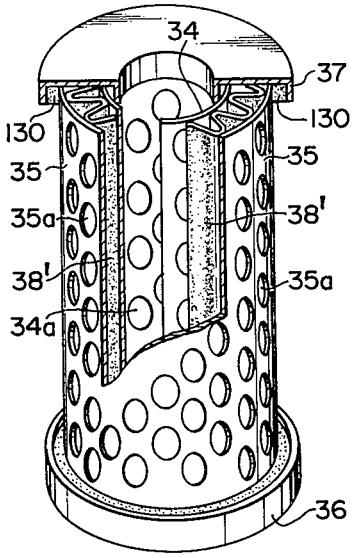
FIG. 17 shows a filter element as used in the example of FIGS. 15 and 16 illustrated partially in cross-section.

FIG. 17 shows the filtering element having a filtering material 38′ of stainless steel gauze wire. In this element, between the left-hand and the right-hand end plates 24 and 25, there are provided inner and outer cylindrical walls 34 and 35. The annular spaces between those two cylindrical walls 34 and 35 receive the filtering material 38′ of stainless steel gauze wire of for sample 500 meshes.

The filtering material 38′ is folded in a circumferential direction along the cylindrical walls 34 and 35. The cylindrical walls 34 and 35 act as reaction plates, as well as a support for the gauze wire.

The end plates 36, 37 and the cylindrical walls 34, 35 are bonded to one another by a heat resistant inorganic adhesive.

The corrugated filtering material 38′ can also be bonded to those plates 36, 37 and walls 34, 35 by the adhesive.

It will be understood that the filtering element 45 divides the space within the casing 16″ into two spaces, the first space includes the outer chamber 41 and inlet space 28 while the second space consists of inner chamber 40.

The first space communicates with the inlet ports 27 and the outlet port 29‴, whereas the second space communicates with the by-pass pipe 107.

The density of the NO*x* in the exhaust gases, which can be reduced by the E.G.R. system, is maximized at almost 75% load.

When the load applied to the engine reaches the above value, i.e. when the density of NO*x* is thick, the valve 108 is opened to permit the recirculation of the exhaust gases through the by-pass pipe 107. Since the exhaust gases must pass through the filtering element 45 before they reach the second space to which the by-pass pipe 107 communicates, the gases returned to the suction manifold have been freed of carbon particles or the like by the filtering material 38′.

Therefore, carbon particles or the like, which would contaminate the suction side of the engine and increase the wear of the cylinder liner, are never returned to the suction side.

In the example as illustrated by FIG. 15, the exhaust gases which are not returned to the suction side of the engine are never cleaned and scattered into the atmosphere.

Figure 18:
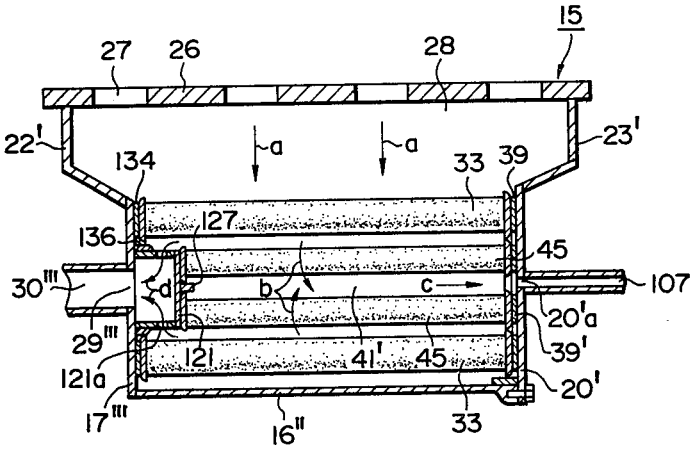
FIG. 18 shows a further example of the embodiment of the second type in section along the longitudinal axis.

However, in the example as shown by FIG. 18, the gases to be scattered are also cleaned by the filtering element 33 which is provided to divide the first space into two sections.

The filtering element 33 may be disposed in almost same manner as in the case of FIGS. 6 through 13. It will be seen from FIG. 18 that the first space is divide into two sections, the one communicates to the inlet ports 27 while the other communicates to the outlet ports 29‴. Therefore, the gases to be returned to the suction side of the engine must pass through two filtering elements 33 and 45, whereby highly cleaned gases are returned to the suction side of the engine, whereas the gases which are to be discharged into atmosphere are cleaned considerably by the filtering element 33.

Hereinafter, explanation will made of the embodiments of the third type, in which a passage is provided for bypassing the filtering element.

In order to obtain a longer service life of the exhaust cleaning device, it is preferable to make the exhaust gases pass through the filtering element only during a predetermined phase of engine operation, which phase would actually necessitate the cleaning of the exhaust gases. In other words, it is not only useless but also inconvenient that the exhaust gases are forced to pass through the filtering element when the engine is under such condition that very little amounts of carbon particles or the like are contained in the exhaust gases.

Figure 19:
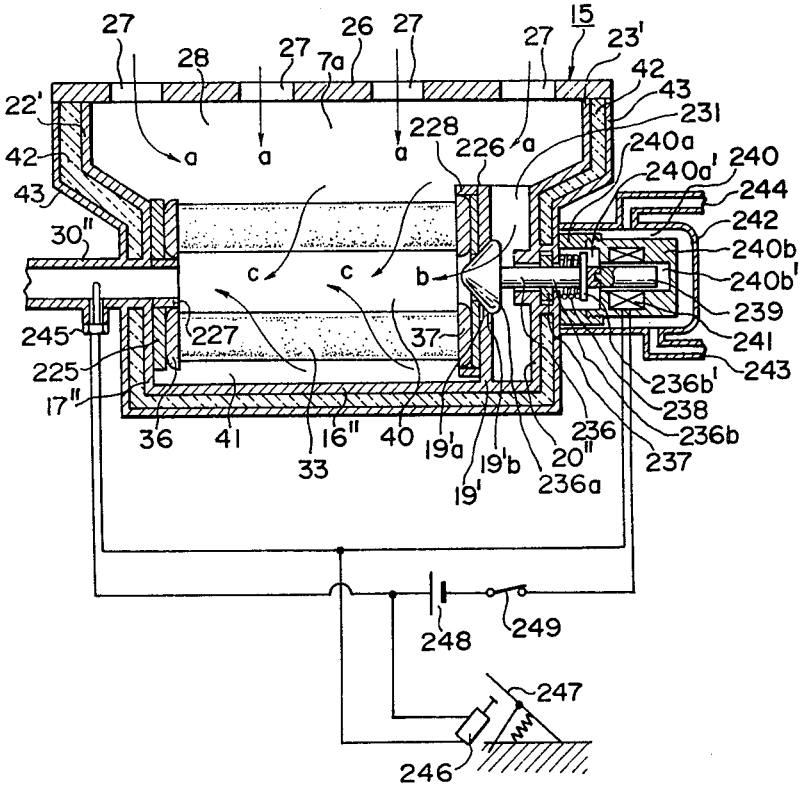
FIG. 19 shows an example of the embodiment of the third type in which a by-pass is provided for directly connecting the outlet port to the first chamber, the gas flow through the by-pass is controlled by a control valve.

Referring to FIG. 19, the space within the casing 16″ is divided into two spaces by the filtering element 33 as in the case of foregoing embodiments.

The first space communicates with the inlet ports 27 and includes the inlet space 28 and the outer chamber 41, whereas the second space communicates with the outlet pipe 30″ and consists of inner chamber 40.

A by-pass port 19*a*′ is provided in the guide plate 19′ for by-passing the filter element 33 and making those two spaces directly communicate with each other. A valve seat 19*b*′ is formed in the by-pass port 19*a*′ for cooperating with the by-pass valve 236. The by-pass valve 236 includes a conical valve head 236*a* for engaging with the valve seat 19*b*′ and a stem 236*b* carrying the head 236*a*. The stem 236*b* penetrates the right-hand side wall 20″ and the outer cover 43, being supported by a bearing 237 which acts as a seal for preventing the gases from escaping. A flange 236*b*′ is formed at near the end of the stem 236*b*, against which a compression spring 38 is pressed so that the valve head 236*a* may be moved to separate from the valve seat 19b'. A plunger 239 of ferromagnetic material is fixed at the end of the stem 236b.

The numeral 240 designates a coil retainer for retaining a magnet coil 241, and includes a cylindrical portion 240a which is secured to the outer cover 43 by means of, for example, a welding, and a supporting portion 240b which is screwed to the cylindrical portion 240a.

The cylindrical portion 240a is not ferromagnetic, but the supporting portion 240b is made of ferromagnetic material. The supporting portion 240b is adapted for receiving the plunger 239 by the bore 240b'. The coil 241 is disposed within the recess formed in a bore 240b'.

Numeral 242 designates a cover for the valve 236 and is formed in a cup-like shape with its open end being attached to the outer cover 43 by, for example, a welding.

The cover 242 is provided with a cooling water inlet pipe 243 and a cooling water outlet pipe 244 for filling the space between the coil retainer 240 and the cover 242 with cooling water of the engine for the purpose of cooling the coil retainer 240 and the coil 241.

The construction is such that when the coil 241 is energized the valve head 236a engages the valve seat 19b' against the biasing force of the spring 238, to close the by-pass passage.

A thermal switch 245 is provided so as to detect the exhaust temperature in the exhaust pipe 30''. The thermal switch 245 may be such a conventional one as a bimetal or a wax which inflates as the temperature gets higher, and is set to close the contact when the exhaust temperature exceeds, for example, 600° C.

The numeral 246 designates a switch for detecting the load applied to the engine, which may be a conventional micro switch positioned to be opened or closed according to the position of the acceleration pedal 247. The switch 246 is set so as to close when the pedal 247 is advanced to a position which corresponds to in excess of 75 % load. The electrical source 248 may be a battery when the engine is for automobiles.

Thermal switch 245 and the load detecting switch 246 are made parallel with each other, each of which being in series with the source 248 and the coil 241, so that the coil 241 may be energized when either one of the switches 245 and 246 is closed.

When the exhaust temperature within the exhaust pipe exceeds 600° C and/or when the load applied to the engine exceeds 75 % load, the coil 241 is energized to close the by-pass passage, whereby the exhaust gases are forced to pass through the filtering element 33. Generally speaking, the amount of carbon particles or the like is large when the load applied to engine is high.

However, because of the load detecting switch 246 which acts to close the valve 236 when the load is heavy, the particles are conveniently caught by the filtering element during this heavy load phase.

When the exhaust temperature is higher than 600° C, the valve 236 is closed whereby the heat energy of the high temperature gases are utilized for burning the carbon substances or the like.

When the engine is operated at relatively light load with relatively low exhaust temperature, the valve 236 is kept opened so that the gases may flow from the first space to the second space directly, whereby the filtering element 33, especially the filtering material 38' is prevented from being unnecessarily heated. It may be recalled that when the load applied to the engine is low and when the exhaust temperature is low, the amount of carbon particles or the like is so small that there is no need for removing those particles.

Figure 20:
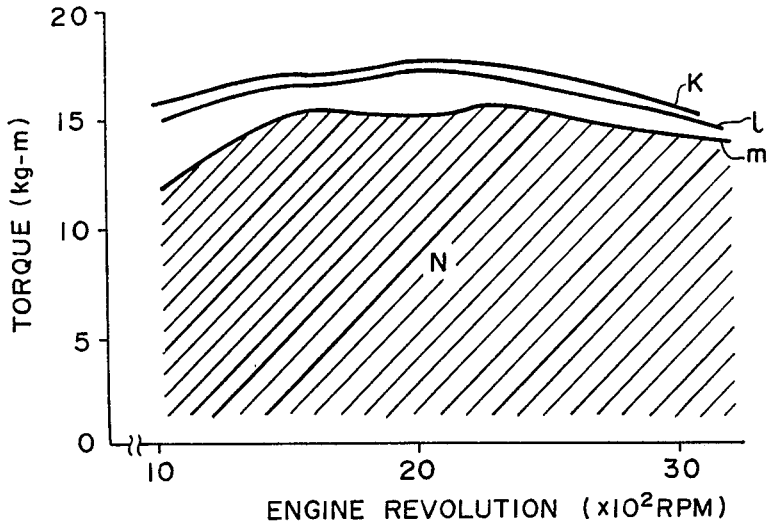
FIGS. 20 and 21 are graphs showing relationships between the torque of the engine and the engine revolutions.

In the diagram of FIG. 20, the curve "K" represents the maximum torque at full load engine operation for each engine revolution of a diesel engine. The curve "*m*" represents the torque valve for each revolution at which torque the smoke density in the exhaust emissions is reduced to a predetermined level. The curve "L" represents the torque valve for each revolution when the exhaust cleaning device is employed, at which torque the smoke density in the exhaust emissions is at the same predetermined level.

Under this circumstance when the load on the engine is such that the smoke density in the exhaust gases is lower than a predetermined level, the by-pass valve 236 is opened by the load detecting switch 246 which is opened or closed in accordance with the position of the accelerating pedal 247, so that the exhaust gases are allowed to flow through the by-pass passage.

It will be understood that by making the gases by-pass the filtering element 33 at such low load engine operation, the filtering element 33 lasts for a longer period and the clogging of the filtering element is prevented. In FIG. 20, the zone "N" represents the phases when the by-pass valve 236 is opened, and this zone corresponds, for example, to phases when the engine load is below 75 %. It should be noted that even when the exhaust valve 236 is opened, the filtering element 33 is kept heated because the exhaust gases of considerably high temperature contact the filtering element even when they flow passing through the by-pass passage.

Thus the heated filtering element acts as a heat accumulator to enhance the burning of the carbon particles or the like.

As aforementioned, when the exhaust temperature exceeds a predetermined level, for example 600° C, as a result of continued engine operation at heavy load, the thermal switch 245 is closed to shut by by-pass valve 236. The curve "O" in the diagram of FIG. 21 represents torque value for each engine revolution, at which torque value the exhaust temperature reaches the predetermined level, i.e. 600° C.

Figure 21:
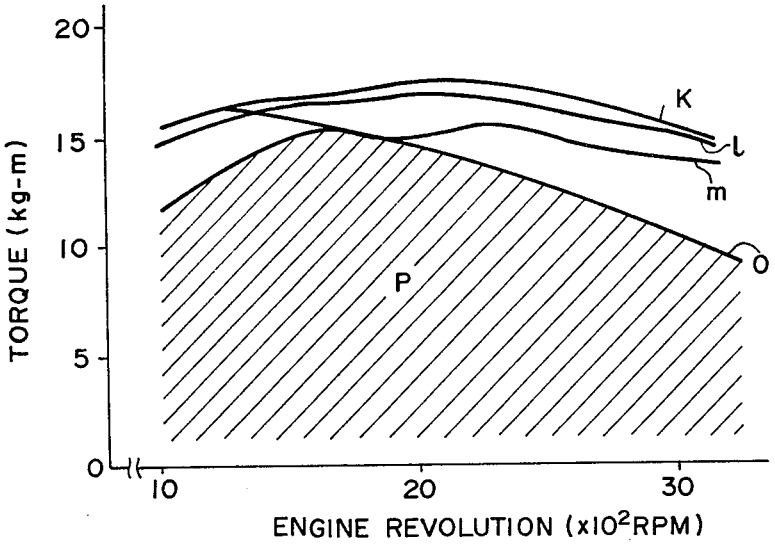

Therefore, the by-pass value 236 is opened when the engine is at phases corresponding to the zone "P" in FIG. 21, when the valve 236 is adapted to be controlled upon detecting both of engine load and exhaust temperature as described.

It is of course possible to control the valve 236 upon detecting only the engine load so as to catch the carbon particles or the like which would increase at heavy load engine operation.

However, in order to burn the carbon particles or the like, it is preferable to close the valve 236 also when the exhaust temperature is high, as described above.

By doing so, the particles caught in the filtering element 33 are effectively burned when the exhaust temperature is higher than 600° C, even if the engine load is at below 75 %, whereby the filtering element is conveniently recovered.

It is still possible to arrange the thermal switch 245 and the load detecting switch 246 in series so that the by-pass valve 236 may be closed only when both of the engine load and the exhaust temperature exceed their respective predetermined levels. By doing so, the filtering element 33 becomes available for longer period since the filtering element 33 is passed by the gases only for a short period during which two requirements for the load and the temperature are satisfied.

As aforementioned, the burning of the particles at the inlet space has been observed to commence when the exhaust temperature reaches up to 500° C.

However, since no free space which is required for the burning is provided in the filtering element 33, the exhaust temperature must be somewhat higher than 500° C in order to obtain a good burning of the clogging particles at the filtering element 33, and this is the reason why the termal switch 245 is set to close at 600° C.

In the first example as described above, the coil 241 is conveniently cooled by the cooling water for the engine 1, which is supplied into the space defined by the coil retainer 240 and the cover 242.

The load detecting switch 246 may, instead of being interlocked with the pedal 247, be interlocked with the rack of the fuel injection pump when the engine 1 is a diesel engine, or may be interlocked with an air restricting valve of the fuel injection pump when said pump is equipped with an air type governer (This governer is known to shift the rack upon detecting a vacuum in a venturi formed in the suction pipe).

Figure 22:
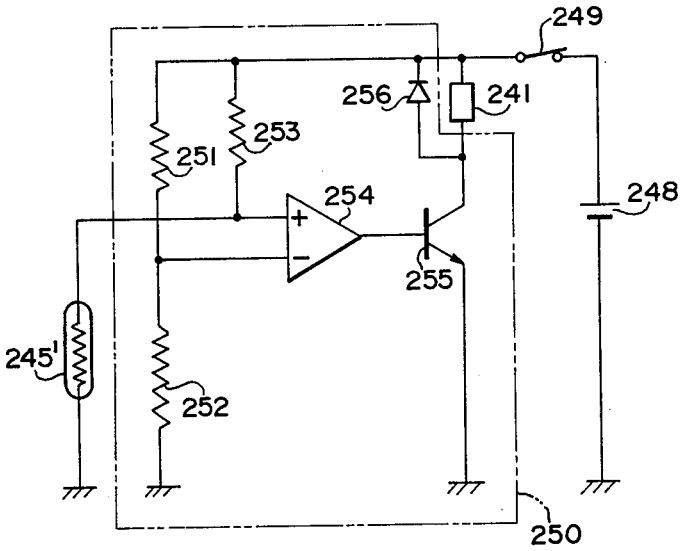
FIG. 22 shows an electric circuit for controlling and actuating the control valve.

It is possible to utilize a heat sensor such as a thermistat or the like for detecting the exhaust temperature. In such a case it is necessary to provide an electric circuit for comparing the output signal with the preset value. FIG. 22 shows an example of such a circuit. In FIG. 22, numeral 245' designates a thermistat and 250 designates a circuit for comparison. The circuit 250 includes divided resistance 251, 252 for setting the preset value, a resistance 253, comparator 254, a transistor 255, and a diode 256 for absorbing the reverse power generated by the coil 241.

When the temperature detected by the thermistat 245' exceeds the preset value which is determined by the ratio between the resistances 251, 252, the resistance value in the thermistat 245' is reduced upon which the comparator 254 acts to turn the transistor 255 to on, whereby the coil 241 is energized.

Figure 23:
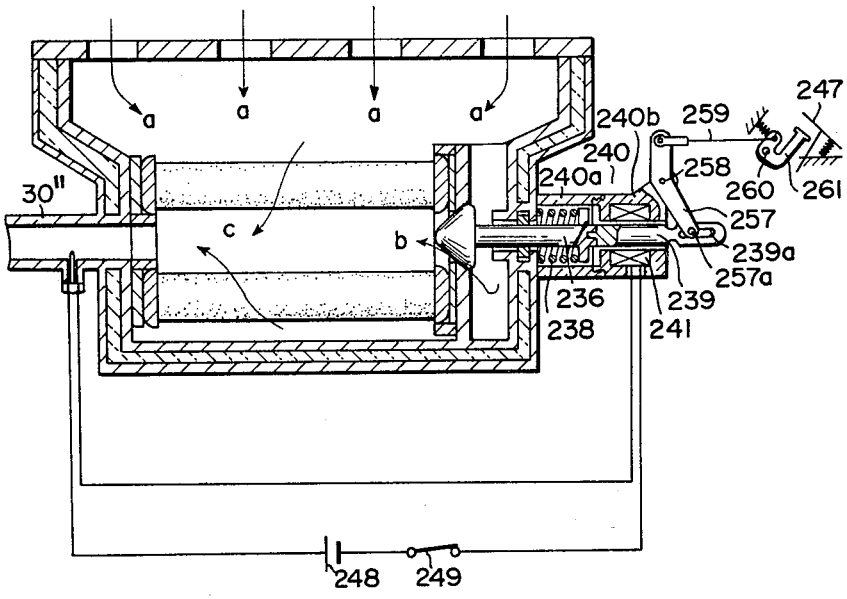
FIG. 23 shows a further example of the embodiment of the third type in section along the longitudinal axis.
Figure 24:
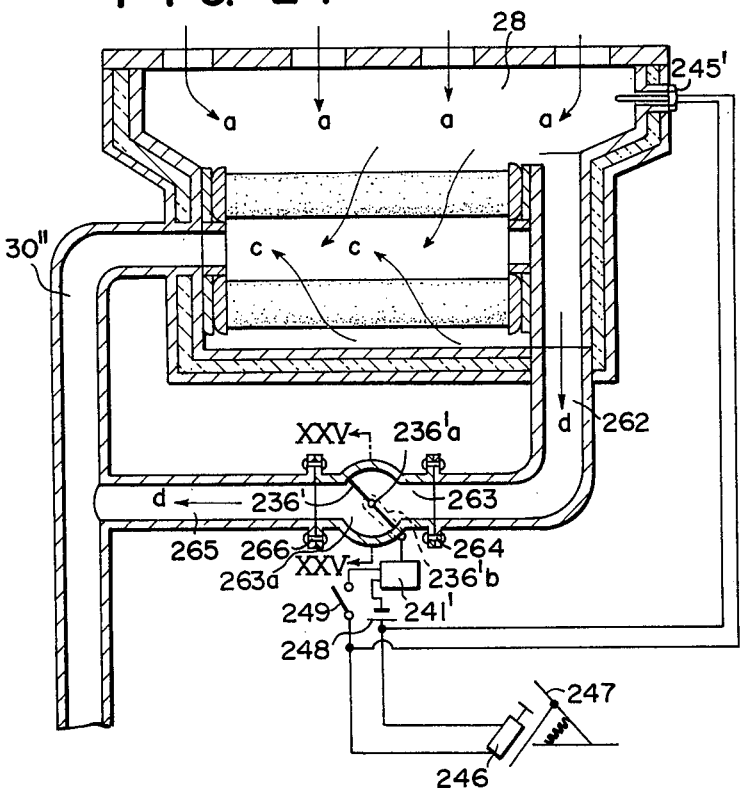
FIG. 24 shows a still further example of the embodiment of the third type in section along the longitudinal axis.
Figure 25:
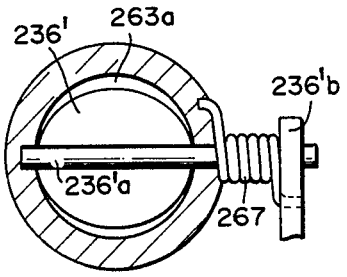
FIG. 25 is a cross-sectional view along the line XXV—XXV of FIG. 24.

FIG. 23 shows the second example of the third type. This example is almost the same as the first one as described with reference to FIG. 19, except that the by-pass valve 236 is operated mechanically. The plunger 239 is projected from the supporting portion **40*b* of the coil retainer 240, said projected portion of the plunger 239 having a slot 239*a* for engaging with a pin 257*a* which is provided at one end of a lever 257**.

The lever 257 is pivoted at its center by the coil retainer 240 through a pin 258, with its one end being connected to a wire 59 which wire 59 in turn is connected to an end of a U shaped lever 61. The U shaped lever 61 is pivoted by a pin 60 and is adapted to be rotated around the pin 60 in accordance with the position of the acceleration pedal 247. Accordingly, the by-pass valve 236 is moved in accordance with the position of the acceleration pedal 247, i.e. in accordance with the load applied to the engine.

Since the slot 239 has a substantial length in the axial direction of the valve 236 to provide a certain lost motion, the magnet coil 241 can actuate the valve 236 independently of the position of the acceleration pedal 247.

It will be understood that the U shaped lever 261 may be associated with a rack of the fuel injection pump.

FIGS. 9 and 10 show a third example of the third type. In this embodiment, a pipe 262 opens at the first space within the casing.

The pipe 262 is connected to a linear pipe 263 which comprises a enlarged portion **263*a* at the center thereof. The linear pipe 263 is in turn connected to another pipe 265 which is in turn connected to the exhaust pipe 30''**.

These pipes are assembled by means of bolts 264 and 266 at respective flanges.

It will be understood that those pipes 262, 263 and 265 in series constitute a by-pass passage for by passing the filtering element.

A disc-like by-pass valve 236' of the butterfly type is disposed within the enlarged portion **263*a* of the linear pipe 263. This valve is supported rotatably by a shaft 263*a'*. The portion of the shaft 236*a'* which projects outwardly of the pipe 263 carries a lever 236*b'* which is associated with an electromagnetic means 241'** in a known manner.

The electro-magnetic means 241' has a construction similar to that of the first and second examples, and is adapted to rotate the valve 236' by attracting the lever **236*b'*** upon energization of a magnet coil.

A torsion spring 267 is provided surrounding the shaft **236*a'* which exerts a force on the lever 236*b'*** to bias the valve towards the full opening position.

Accordingly, the by-pass valve 236' usually assumes the fully opened position, and is rotated to the closing position as illustrated by full line in FIG. 9 when the electro-magnetic means 241' is energized. The electrical power is supplied to the electro-magnetic means 241' in the same manner as the foregoing examples, excepting that the thermal switch 245' is provided at the inlet space 29.

It will be understood that when the by-pass valve 236' is opened almost all of the exhaust gases flow through the by-pass passage without passing through the filtering element 33, and when the by-pass valve is closed the gases are forced to pass through the filtering element to be got rid of the carbon particles or the like.

The electro-magnetical means 241' may be substituted by an electric motor.

The adoption of the butterfly type valve makes it easy to control the quantity of the gases passing through the by-pass valve analogously in both electrical and mechanical ways.

Figure 26:
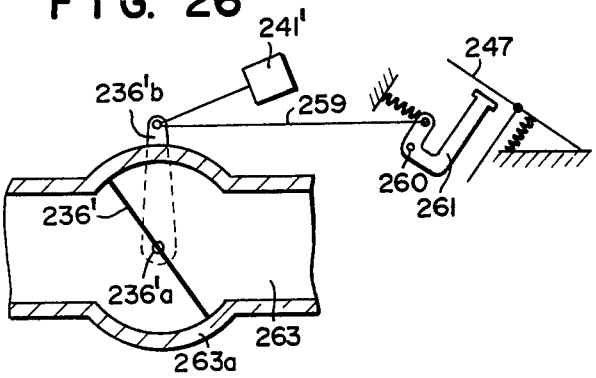
FIG. 26 shows an important portion of a still further example of the third type.

FIG. 26 shows the fourth example of the third type in which the opening degree of the by-pass valve 236' is controlled analogously in accordance with the load mechanically.

The U shaped lever 261 is pivoted by a pin 260 and is adapted to be rotated as the accelerating pedal 247 advances. A wire 259 is connected to one end of the U shaped lever 261 at its one end, and connected to a lever **236*b'* at its other end. Thus, the opening degree or passage area of the valve 236' is varied in accordance with the rotational movement of the shaft 236*a'*** so that the flow rate of the exhaust gases through the by-pass passage is analogously controlled in accordance with the position of the acceleration pedal, i.e. the load applied to the engine.

Figure 27:
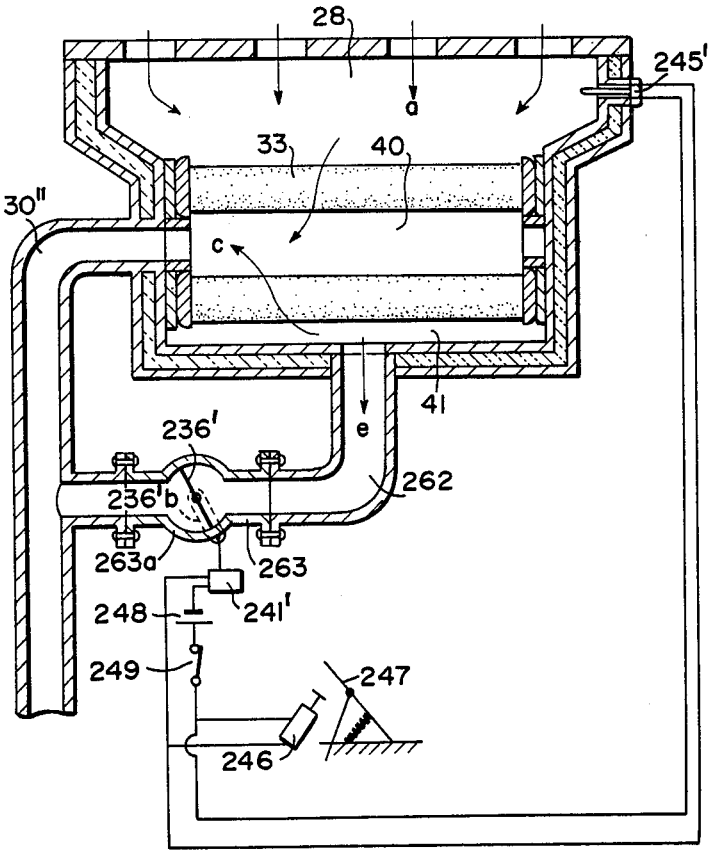
FIG. 27 shows a still further example of the embodiment of the third type taken along the axis line.

FIG. 27 shows the fifth example of the third type. In this example, the first space includes the inlet space 28 and the outer chamber 41, while the second space is constituted by the inner chamber 40. The pipe 262 which constitutes a portion of the by-pass passage communicates with the outer chamber 41 which constitutes a portion of the first space. In this construction, the gases introduced to the cleaning device as an arrow "*a*" flow around the filtering element 33 and escapes from the by-pass passage as an arrow "*e*" when the valve 236' is opened.

On the contrary, when the valve 236' is closed, the gases are forced to flow through the filtering element as an arrow *c*, whereby the carbon particles or the like are caught by the filtering element 33.

In the foregoing examples, a small quantity of the gases unavoidably flow through the filtering element, even when the by-pass valve is kept fully opened. Although this problem is usually not serious because the carbon particles or the like are lean when the by-pass valve is kept opened, this may cause a clogging of the filtering element since the exhaust temperature is not high enough to burn the carbon particles.

Therefore, it is required that the gases never pass through the filtering element when the by-pass valve 236' is kept opened.

Figure 28:
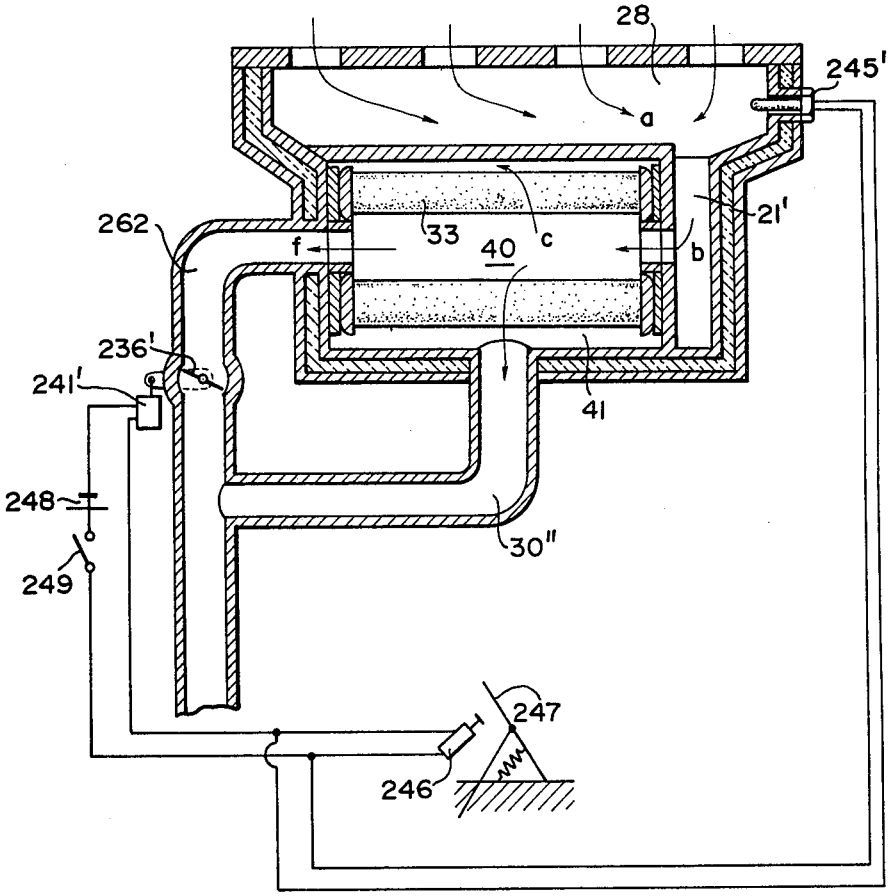
FIG. 28 shows a still further example of the embodiment of the third type taken along the axis line.

In the sixth example as shown by FIG. 28, the filter is improved in that the exhaust gases never pass the filtering element when the by-pass valve 236' is kept opened.

As clearly seen from FIG. 28, the first space is constituted by the inlet space 28, the passing space 21' and the inner chamber 40, whereas the second space is constituted by the outer chamber 41.

Those two spaces are separated from each other by the filtering element 33.

The exhaust pipe 30'' is disposed to open in the outer chamber 41 facing the cylindrical wall of the filtering element 33.

As clearly seen from the Figure, the gases which flow through the inner chamber are not baffled or interrupted by the wall of the filtering element, so that the exhaust gases do not pass through the filtering element when the by-pass valve 236' is kept opened.

What is claimed is:

1. An exhaust cleaning device comprising a body defining a space therein having at least one inlet port and an outlet port, an annular heat resistant filtering element having a filtering material which is corrugated in a circumferential direction so as to form a wall having a corrugated round cross-section, said wall dividing the space within the body into first and second spaces, said first space communicating with said at least one inlet port and said outlet port, said second space communicating with the suction side of an internal combustion engine through a by-pass pipe, said at least one inlet port being adapted to directly communicate with a corresponding exhaust port of said internal combustion engine.

2. An exhaust cleaning device as claimed in claim 1, wherein said first space is divided into two sections by a second annular heat resistant filtering element, one of said sections communicating with said inlet port while the other communicates with said outlet port.

3. An exhaust gas cleaning device for an internal combustion engine comprising a casing adapted to be directly attached to the engine and having inlet ports corresponding in number to the number of cylinders of the engine, each of said inlet ports being adapted to be directly connected to a corresponding exhaust port of said cylinders, said device including at least two outlets, at least one tubular filtering element disposed in said casing to divide the space within said casing into two spaces, said filtering element being pleated circumferentially, one of said two spaces being communicated with one of said two outlets and with said inlet ports, the other of said two spaces being communicated with the other of said two outlets and being communicated through said filtering element with said one of two spaces.

4. The exhaust gas cleaning device of claim 3 wherein a first one of said outlets is connected to the intake manifold of said engine and the second one of said two outlets is connected to an exhaust pipe and wherein said one of said two spaces is communicated with said exhaust pipe connected outlet and the other of said two spaces is communicated with said intake manifold connected outlet.

5. The exhaust gas cleaning device of claim 4 wherein said tubular filtering element comprises a first inner filter element supporting cylinder, a second outer filter element supporting cylinder, said outer and said inner cylinder defining an annular space therebetween for receiving a filter element and said outer and inner cylinders having a plurality of holes therethrough for permitting the passage of exhaust gases therethrough, and wherein said filtering element is positioned between said inner and outer cylinders and is pleated circumferentially.

6. An exhaust gas cleaning device for an internal combustion engine comprising a casing adapted to be directly attached to the engine and having inlet ports corresponding in number to the number of cylinders of the engine from which exhaust gases are coupled to said device, each of said inlet ports being adapted to be directly connected to a corresponding exhaust port of said cylinders and each device having at least two outlets, at least two tubular filtering elements disposed in said casing to divide the space within said casing into a first exhaust gas receiving space, a second exhaust gas discharging space and a third exhaust gas recirculation space, said exhaust gas receiving space being communicated directly with said inlet ports, said exhaust gas discharging space being communicated with an exhaust gas discharge port of said casing and said exhaust gas recirculation space being communicated with an exhaust gas recirculation port of said casing.

7. The exhaust gas cleaning device of claim 6 wherein the flow of exhaust gases from said first space to said exhaust gas discharge port is through a first tubular filtering element and wherein the flow of exhaust gases from said first space to said exhaust gas recirculation port is through said first tubular filtering element and a second tubular filtering element.

8. The exhaust gas cleaning device of claim 7 wherein each of said tubular filtering elements comprises a first inner filter element supporting cylinder, a second outer filter element supporting cylinder, said inner and outer filtering element supporting cylinders defining an annular space therebetween and said inner and outer filter element supporting cylinders having a plurality of holes therethrough for permitting the passage of exhaust gases with respect thereto, and a pleated tubular filtering element positioned in said annular space.

9. An exhaust gas cleaning device for an engine including an intake system, cylinders and an exhaust system comprising:

a body defining a space therein, a flange integrally formed at an end of said body for directly attaching said body to the engine through only a gasket, an outlet pipe fixed to said body for connecting said space with said exhaust system, a filtering element made of a heat resistant material and disposed in said body in a manner to divide said space into a first and a second space, said first space being communicated with said second space through said filtering element, a second filtering element disposed in said body to divide said first space into two sections, said two sections being communicated through said second filtering element, inlet ports formed in said flange and corresponding in number to the number of said cylinders of said engine, said inlet ports opening to said first space, and a by-pass pipe fixed to said body for connecting said second space with said intake system, one of said sections defined between both said filtering elements being communicated with said outlet pipe while the other section being communicated with said inlet ports.

* * * * *